United States Patent [19]

Nakamura

[11] Patent Number: 4,562,899

[45] Date of Patent: Jan. 7, 1986

[54] DIAPHRAGM OF ELECTROACOUSTIC TRANSDUCER AND METHOD OF MANUFACTURING THE SAME

[75] Inventor: Akira Nakamura, Shizuoka, Japan

[73] Assignee: Nippon Gakki Seizo Kabushiki Kaisha, Japan

[21] Appl. No.: 504,192

[22] Filed: Jun. 14, 1983

[30] Foreign Application Priority Data

Jun. 16, 1982 [JP] Japan ..... 57-102261
Jun. 16, 1982 [JP] Japan ..... 57-88706[U]

[51] Int. Cl.[4] ..... G10K 13/00; H04R 7/02

[52] U.S. Cl. ..... 181/169; 181/170; 428/58; 428/65; 428/155

[58] Field of Search ..... 181/164–170, 181/294; 179/115.5 R, 115 R, 181 R; 428/54, 57, 58, 64, 65, 155

[56] References Cited

U.S. PATENT DOCUMENTS

| | | | |
|---|---|---|---|
| 1,180,401 | 4/1916 | Johnson | 181/164 |
| 1,802,910 | 4/1931 | De Jongh | 181/165 |
| 1,807,225 | 5/1931 | Pack | 181/164 |
| 3,350,513 | 10/1967 | Roberts | 181/164 X |
| 4,410,768 | 10/1983 | Nakamura et al. | 181/170 X |
| 4,413,860 | 11/1983 | Prescott | 428/65 X |

FOREIGN PATENT DOCUMENTS

| | | | |
|---|---|---|---|
| 0075429 | 6/1977 | Japan | 181/170 |
| 53-24812 | 7/1978 | Japan . | |
| 0079524 | 7/1978 | Japan | 181/169 |
| 55-7759 | 2/1980 | Japan . | |
| 56-6191 | 2/1981 | Japan . | |

*Primary Examiner*—Benjamin R. Fuller
*Attorney, Agent, or Firm*—Remy J. VanOphem

[57] ABSTRACT

A diaphragm of a loudspeaker is made up of a plurality of laminated composite sheets each including a number of fibers, for example, carbon fibers having a high Young's modulus to density ratio, and a matrix bonding together the fibers. Each composite sheet is divided into a plurality of adjoining sections formed by dividing the composite sheet about the center axis of the diaphragm. The divided composite sheets are laminated such that joints between adjacent sections of one composite sheet do not overlap joints between adjacent sections of the other composite sheet. In other embodiments a similar composite sheet is spirally bonded to the outer surface of the diaphragm or rings having different diameters and made of similar composite sheet are coaxially bonded along the outer surface of the diaphragm.

12 Claims, 24 Drawing Figures

DIAPHRAGM OF ELECTROACOUSTIC TRANSDUCER AND METHOD OF MANUFACTURING THE SAME

BACKGROUND OF THE INVENTION

This invention relates to a diaphragm of an electroacoustic transducer, such as a microphone, and more particularly a diaphragm having a uniform vibration characteristic over a wide frequency bandwidth and improved durability and reliability, and a method of manufacturing such a diaphragm.

The frequency bandwidth of such electroacoustic transducer, such as a loudspeaker, is generally determined by the material of the diaphragm so that it is necessary to use material having a lightweight, a large Young's modulus to density ratio $E/\rho$ and a large flexural rigidity E·I (where E represents Young's modulus, $\rho$ density, and I secondary moment of section) and having a suitable value of internal loss tan $\delta$. More particularly, the higher is the Young's modulus to density ratio $E/\rho$, the larger is the high tone limit frequency (fh) which broadens the piston motion range. Accordingly, the frequency bandwidth of the loudspeaker is widened. Furthermore, as the flexural rigidity E·I is increased, strain is decreased, and when the internal loss tan $\delta$ has a suitable value, the Q-value of the partial resonance of the diaphragm is decreased to a suitable value making it difficult for partial vibration to occur thus, making flat the characteristic (there is no coloring of the reproduced sound). In the design of a diaphragm, as it is necessary to reproduce a transient waveform signal containing high frequency components (this is true in most musical signals), a wide bandwidth characteristic is desired. For the reasons described above, it is important to select a suitable material. In recent years, beryllium having higher Young's modulus to density ratio $E/\rho$ than aluminum alloys, and titanium alloys have been used.

However, beryllium is not only expensive but also brittle and difficult to be worked. Accordingly, recently a composite material constituted by fibers having a high Young's modulus to density ratio, for example carbon fibers, and a matrix, such as epoxy resin which combines the fibers, has been used. When compared with the prior art light alloys described above, such composite material has a larger Young's modulus E and a smaller density $\rho$ so that its Young's modulus to density ratio $E/\rho$ is large and it has a desirable frequency characteristic over a wide frequency bandwidth. Moreover, the composite material can be facilely manufactured at a low cost.

According to a prior art method, a dome-shaped diaphragm 2, as shown in FIG. 1*a*, was prepared by cutting a flat sheet 1 formed by aligning in the direction A a number of fibers having a high Young's modulus to density ratio (as shown in FIG. 1*b*) into a configuration corresponding to a development of a dome-shaped diaphragm such that the fibers intersect at right angles with the bottom circle of the dome, and then bonding the cut portions with a matrix material into a dome as shown in FIG. 1*a*. Consequently, the bonding force at the joints 3 is not sufficient so that these joints would be broken under a high output vibration condition, thus decreasing the durability and reliability of the resulting diaphragm.

More particularly, when the fiber sheet 1 is cut into a saw toothed shape and the side edges of adjacent teeth are bonded together the ends of some of the fibers would be abutted. In such a case, the resin acting as the bonding agent does not enter between the abutting ends, thus decreasing the bonding force. To obtain sufficient bonding strength it is desirable that the ends of the fibers of adjacent teeth be staggered. Moreover, when the ends of the fibers are abutted, air layers would be formed therebetween, thus decreasing the bonding strength.

SUMMARY OF THE INVENTION

It is an object of the present invention to provide an improved diaphragm having a large mechanical strength, and high durability and reliability and a method of manufacturing the same.

Another object of the present invention is to provide a diaphragm having a uniform vibration characteristic over a wide frequency bandwidth and a method of manufacturing the same.

Still another object of the present invention is to provide a novel diaphragm that can be designed and manufactured readily and a method of manufacturing the same.

According to one aspect of the present invention, there is provided a diaphragm of an electroacoustic transducer which has a plurality of composite sheets each including fibers having a high Young's modulus to density ratio and a matrix bonding together the fibers, the composite sheets being laminated into an integral structure, each composite sheet including a plurality of adjoining sections formed by dividing the composite sheet about the center axis of the diaphragm, and the divided composite sheets being laminated such that joints between adjacent sections of one composite sheet are not disposed circumferentially at the same positions as those of overlapping joints between adjacent sections of the other composite sheet.

According to another aspect of the present invention there is provided a method of manufacturing a diaphragm of an electroacoustic transducer which includes the steps of preparing a prepreg-sheet of a plurality of fibers extending in the same direction and having a high Young's modulus to density ratio with a curable matrix, dividing the prepreg-sheet into sections of substantially equal size, laminating a plurality of divided prepreg sections arranged so as to form at least two layers so that joints between adjacent sections of one layer are displaced circumferentially from joints between adjacent sections of the other layer, and applying heat and pressure to the laminated prepreg-sections so as to cure the matrix thereby forming an integral structure.

BRIEF DESCRIPTION OF THE DRAWINGS

In the accompanying drawings.

DESCRIPTION OF THE PREFERRED EMBODIMENT

Figure 1A:
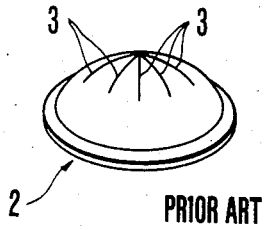
FIGS. 1*a* and 1*b* are respectively, a perspective view and a developmental view of a prior art dome-shaped diaphragm made of composite material.
Figure 1B:
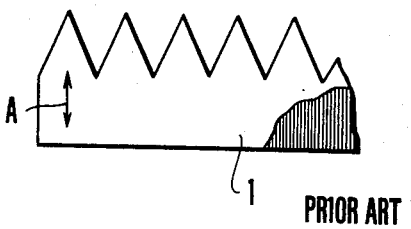
Figure 2:
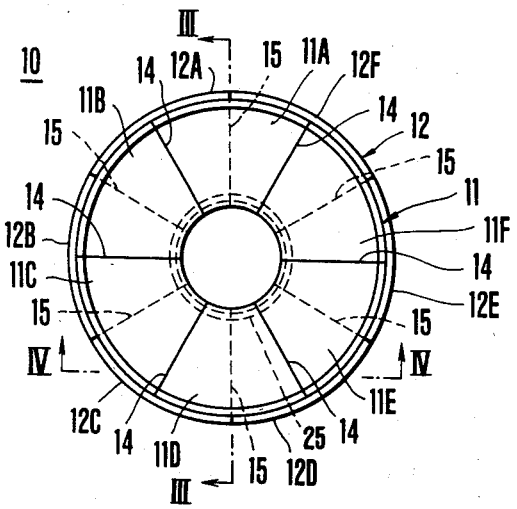
FIG. 2 is a front view showing one embodiment of a cone-shaped diaphragm according to the present invention.
Figure 3:
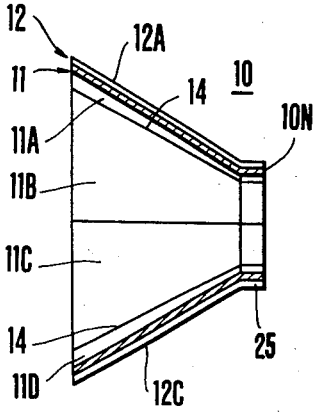
FIG. 3 is sectional view taken along a line III—III of FIG. 2.
Figure 4:
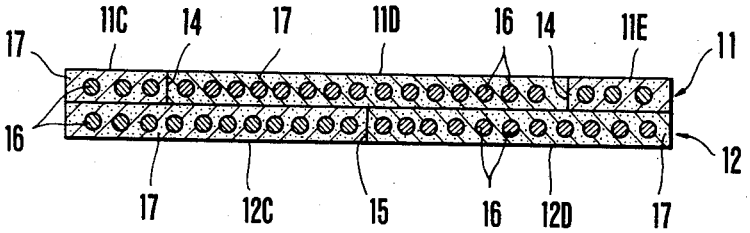
FIG. 4 is an enlarged developmental sectional view taken along a line IV—IV in FIG. 2.

Referring now to FIGS. 2, 3 and 4, a cone-shaped diaphragm 10 is constituted by two overlapped composite sheets 11 and 12 of the same construction and formed with an integral neck 25 at its base opening. A bobbin wound with a voice coil (not shown) is secured to the neck 25.

The composite sheets 11 and 12 are respectively constituted by six sections 11A to 11F and 12A to 12F formed by equally dividing the cone-shaped diaphragm in the circumferential direction. When developed on a horizontal plane, each of the sections 11A to 11F and 12A to 12F has a configuration of a frustum and side edges of adjacent sections are bonded together so that the side edges are not overlapped. The inner composite sheet 11 and the outer composite sheet 12 are laminated about 30° displaced in circumferential direction so that the joints 14 of the inner sections 11A to 11F are positioned at substantially the centers of the outer sections 12A to 12F. In the same manner, the joints 15 of outer sections too are positioned at substantially the centers of the inner sections 11A to 11F. Under these conditions, all sections 11A to 11F and 12A to 12F are heated and pressed, as will be described later, into a cone-shaped diaphragm 10 of an integral structure. In this manner, the joints 14 of the inner sections 11A to 11F are reinforced by the outer sections, and the joints 15 of the outer sections 12A to 12F are reinforced by the inner sections.

Figure 5:
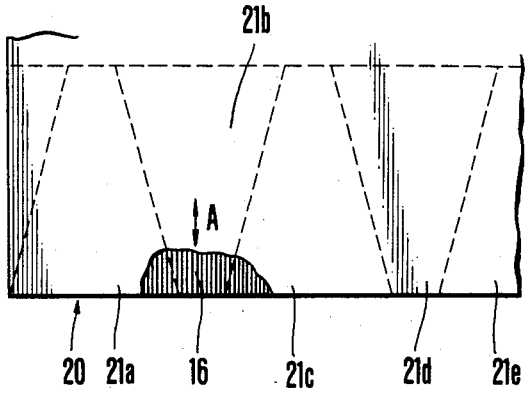
FIG. 5 is a fragmentary sectional view of a sheet in which fibers are arranged unidirectionally.
Figure 6:
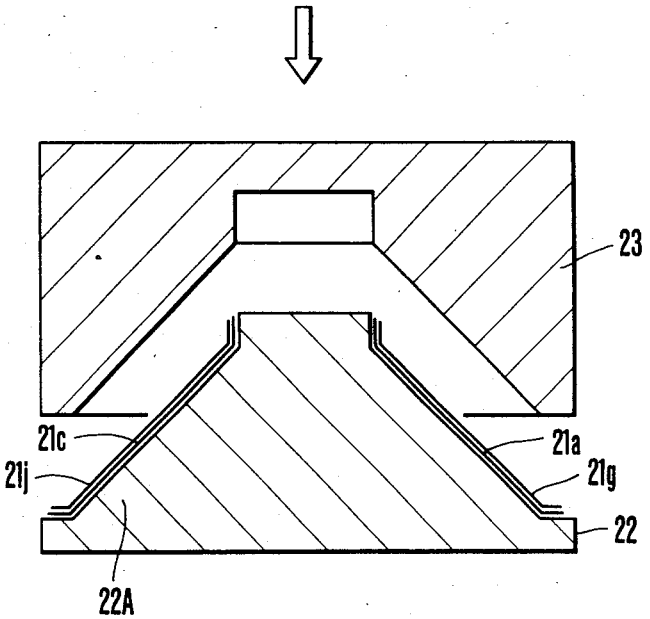
FIG. 6 is a sectional view depicting the molding operation of a diaphragm.

As shown in FIG. 4, each of the inner and outer composite sheets 11 and 12 are constituted by a plurality of carbon fibers 16 having a high Young's modulus to density ratio and arranged in one direction, and a matrix 17 consisting of such thermosetting resin as epoxide resin, phenol resin unsaturated polyester resin, etc. and adopted to integrally bond together the carbon fibers 16. As shown in FIG. 5, to prepare the cone shaped diaphragm, a prepregnated sheet 20 in which carbon fibers 16 are arranged in a direction of arrow A and impregnated with epoxide resin in a B or semicured state is cut such that the carbon fibers orient in the same direction so as to obtain a plurality of frustum shaped prepreg-sections 21*a* to 21*l* of the same size. The prepreg-sections 21*a* to 21*l*, thus obtained, are disposed on the frusto-conical portion 22A of a male metal mold 22 having a configuration corresponding to the cone-shaped diaphragm 10 to be formed, as shown in FIG. 6. Since after molding, the prepreg-sections 21*a* to 21*l* form the composite sheet 11 or 12, the prepreg-sections 21*g* to 21*l* of the second layer are to be disposed on the prepreg-sections 21*a* to 21*f* of the first layer disposed on the surface of the frusto-conical portion 22A, with the prepreg-sections of the first and second layers displaced 30° in the circumferential direction. Then a female metal mold 23 is pressed against the male metal mold 22 and heated to about 150° C. Due to the applied heat and pressure, the matrix, that is the B stage epoxide resin of the prepreg-sections 21*a* to 21*l* sets to bond together the carbon fibers as well as all prepreg-sections 21*a* to 21*l* into an integral structure.

Figure 7:
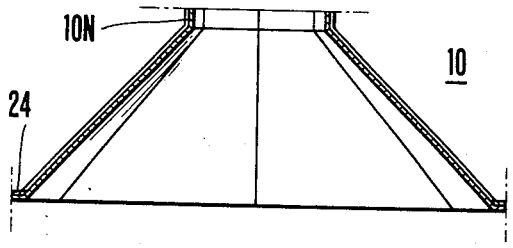
FIG. 7 is a sectional view depicting a cut cutting end of the molded diaphragm.

After heat setting of the matrix, the molded cone is taken out from between the male and female metal molds 22 and 23, respectively, and an outer flange 24 of the molded cone is cut to have a predetermined outer diameter as shown in FIG. 7, while the neck portion 10N is cut to have a predetermined length, thus obtaining a cone-shaped diaphragm 10 of the laminated construction which has a composite material including carbon fibers of each section disposed in the direction parallel to the central line of the section and a matrix of epoxide resin.

If should be noted here that, by disposing the prepreg-sections 21*a* to 21*l* so as not to be overlapped relative to each other and not to separate at their edge portions, the carbon fibers are uniformly disposed in the molded diaphragm of the composite material, with a result that the uniformity of the diaphragm material and its characteristics can be obtained.

Figure 8A:
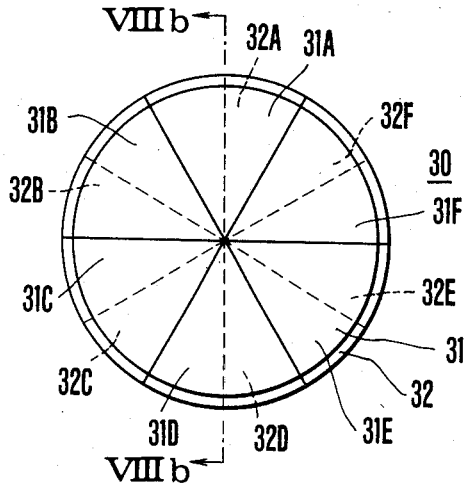
FIG. 8*a* is a front view showing a dome shaped diaphragm embodying the invention.
Figure 8B:
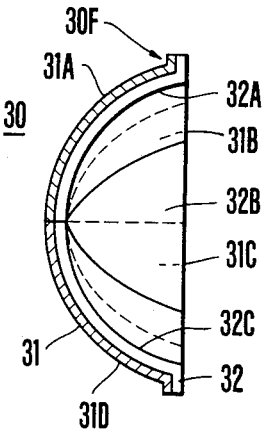
FIG. 8*b* is a sectional view taken along line VIII*b*—VIII*b* in FIG. 8*a;*

Although in the foregoing description, the invention was applied to a cone-shaped diaphragm, the invention is not limited to such specific configuration but can also be applied to a dome-shaped diaphragm and to the center cap of a cone-shaped diaphragm. For example, a dome-shaped diaphragm 30 shown in FIGS. 8*a* and 8*b* includes an outer composite sheet 31 and an inner composite sheet 32 in the same manner as in the cone-shaped diaphragm 10 described above. Furthermore, the composite sheets 31 and 32 are laminated such that the joints between outer sections 31A to 31F would not overlap the joints between the inner sections 32A to 32F. In other words, the inner and outer sections are displaced from each other by 30° in the circumferential direction. As shown in FIG. 8*b*, a reinforcing flange 30F is formed at the outer periphery of the diaphragm 30.

Although in the foregoing embodiments two composite sheets were laminated, if desired, three or more composite sheets may be laminated.

A modified diaphragm for use in an electroacoustic transducer will be described in which the vibration characteristics are improved by increasing the peripheral rigidity and by imparting isotropic properties.

More particularly, since carbon fibers in the embodiments above were oriented almost in the radial direction, a directivity caused by the orientation of the carbon fibers is inevitable so that the rigidity of the diaphragm in the peripheral direction is much lower than that in the radial direction, thereby resulting in a temple bell vibration (a split vibration in which radial nodes are formed on the diaphragm). For this reason, it should be considered that the fibers be arranged in all directions to provide isotropic characteristics. Actually, however, it is not only difficult to arrange the carbon fibers in all directions but also the efficiency is decresed due to increased weight.

For this reason, in this modification, the diaphragm is constituted by a composite sheet of a predetermined shape in which the fibers are aligned nearly in the radial direction of the diaphragm, and a stripe shaped sheet in which the fibers are disposed in the peripheral direction, that is about in a direction orthogonal to the direction of the fiber of the composite sheet. This construction can prevent the temple bell type vibration and manifest an excellent vibration characteristic.

Figure 9:
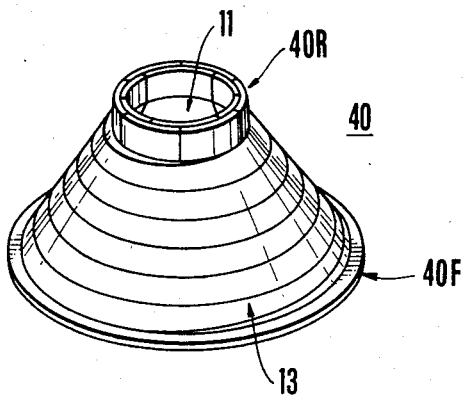
FIG. 9 is a perspective view of a cone-shaped diaphragm designed for preventing partial vibrations.
Figure 10:
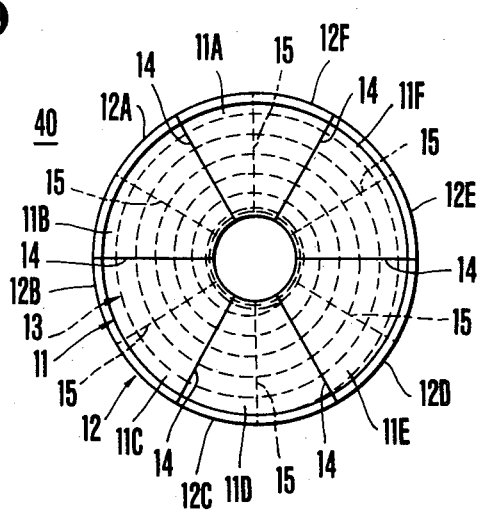
FIG. 10 is a front view of the diaphragm shown in FIG. 9.
Figure 11:
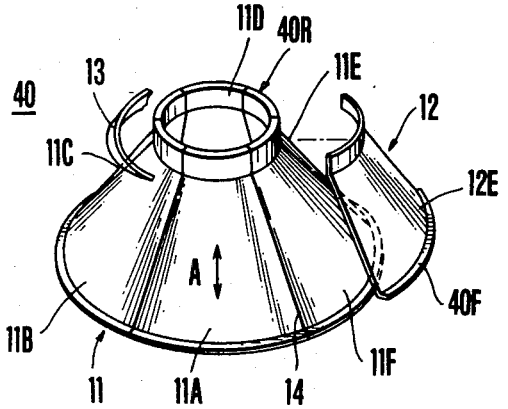
FIG. 11 is an exploded view with certain portions removed of the diaphragm shown in FIG. 9.

FIGS. 9, 10 and 11 show a modified cone-shaped diaphragm 40 constituted by laminated first and second frusto-conical composite sheets 11 and 12 and a stripe sheet 24, that is, a sheet whose length is substantially greater than its width, spirally laminated on the surface of the outer composite sheet 12. It should be noted that the number of the composite sheets is not limited to two, but any desired number of the sheets can be used. In FIG. 11, reference numerals 40R and 40F designate a reinforcing rib and a reinforcing flange respectively, provided for the inner and outer peripheries of the cone-shaped diaphragm.

The first and second composite sheets 11 and 12 have the same construction as those shown in FIGS. 2 through 4 so that corresponding elements are designated by the same reference characters.

Figure 12:
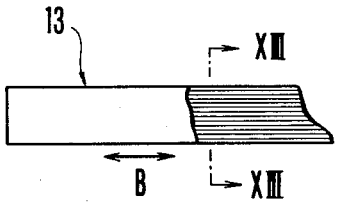
FIG. 12 is fragmental sectional view showing a stripe shaped fiber sheet.
Figure 13:
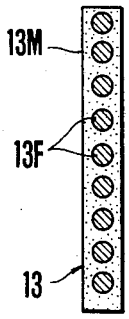
FIG. 13 is a sectional view showing the fiber sheet shown in FIG. 12, taken along line XIII—XIII in FIG. 12.

The stripe sheet 13 is also made of carbon fibers and a matrix in the same manner as the first and second composite sheets 11 and 12. More particularly, as shown in FIGS. 12 and 13, the stripe sheet 13 is constituted by a plurality of carbon fibers 13F extending in the longitudinal direction (the direction B in FIG. 12) of the stripe sheet 13 and a matrix 13M, for example epoxide resin, that bonds together the carbon fibers. The stripe sheet 13 is spirally laminated on the surface of the second composite sheet 12. The direction of the carbon fibers of the sheet 13 is about the same as the peripheral direction of the diaphragm 40 but orthogonal to the direction of the carbon fibers of the first and second composite sheets 11 and 12 as shown by Arrow A.

Figure 14:
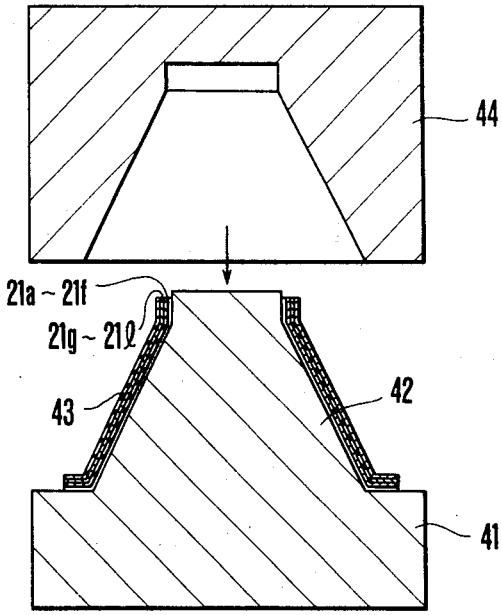
FIG. 14 is a sectional view showing a method of manufacturing a diaphragm shown in FIG. 9.

To manufacture the cone-shaped diaphragm 40, as has been described in connection with FIG. 5, prepreg-sections 21*a* to 21*l* are firstly prepared which are laminated on the periphery of a frusto conical portion 42 of a male metal mold 41 shown in FIG. 14. In this example six prepreg-sections 21*a* to 21*f* are disposed about the frusto conical portion with no gap between adjacent sections. Then other 6 prepreg-sections 21*g* to 21*l* are laminated on the prepreg-sections 21*a* to 21*f* with no gap between adjacent sections, and each displaced 30° in the peripheral direction. Then a stripe sheet 43 consisting of longitudinally extending carbon fibers and impregnated with epoxide resin at B stage (semicured) is spirally wound about laminated prepreg-sections 21*a* to 21*l*. The assembly is molded by male and female metal molds 41 and 44 under a pressure and at a temperature of 150° C. so as to cure the matrix of the prepreg-sections 21*a* to 21*l* and of the stripe sheet 43, thereby molding an integral structure.

After heat curing the matrix, the molded diaphragm is taken out from between the male and female metal molds 41 and 44, respectively. The laminated cone-shaped diaphragm 40, thus obtained, is constituted by the first and second composite sheets 11 and 12 in which carbon fibers extend approximately in the radial direction of the diaphragm and the stripe sheet 13 in which the carbon fibers 13F extend about in the peripheral direction.

With this cone shaped-diaphragm 40, since the laminated stripe sheet 13 increases the rigidity in the peripheral direction, an isotropic characteristic is imparted to the diaphragm, thus preventing generation of temple bell type vibrations.

Figure 15:
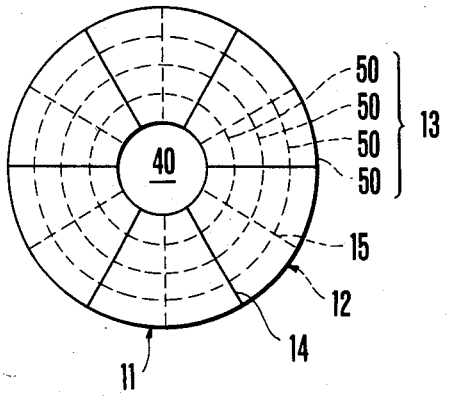
FIG. 15 is a front view showing a modification of the diaphragm shown in FIG. 9.
Figure 16:
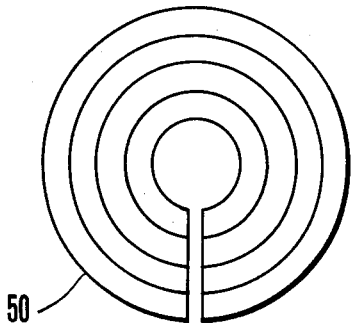
FIG. 16 is a plan view showing the ring-shaped sheet 50 shown in FIG. 15.

FIG. 15 shows another modification of this invention which is different from the embodiment shown in FIGS. 9 through 11 in that rings of a stripe sheet 50 having different diameters are laminated coaxially. In this modification, the inner and outer diameters of the ring-shaped stripe sheets 50 increase toward the front opening of the diaphragm a shown in FIG. 16. Each of the stripe sheets 50 can be manufactured by cutting the strip sheets 13, as shown in FIGS. 12 and 13, into a predetermined length and then bending the stripe sheets 13, thus cut, into a ring.

Additionally with the modified diaphragm 40, since the carbon fibers constituting the ring-shaped stripe sheets extend in the peripheral direction of the diaphragm 40, the same advantageous effects as in the foregoing embodiment shown in FIG. 9 can be obtained.

Figure 17:
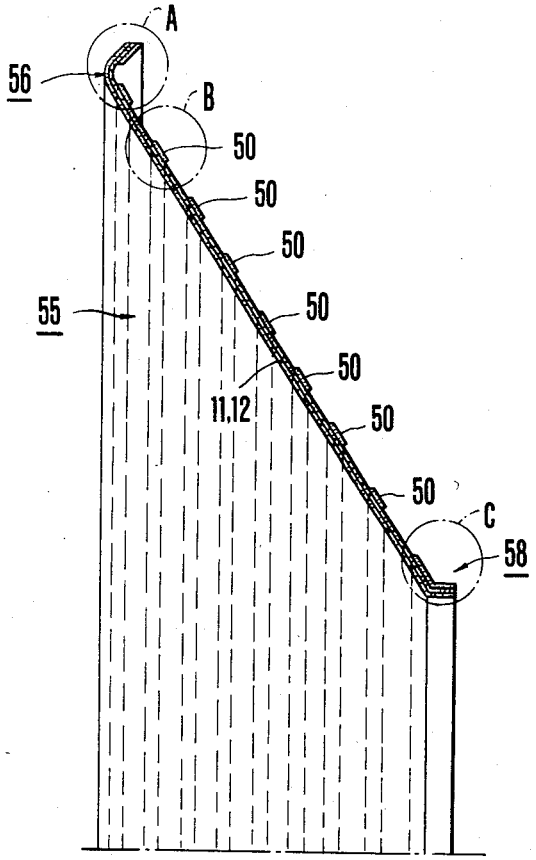
FIG. 17 is a partial sectional view of the modified diaphragm shown in FIG. 15.
Figure 18:
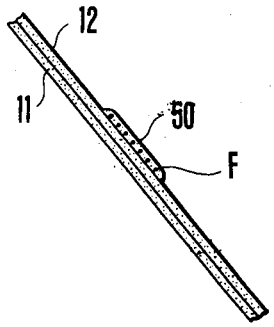
FIGS. 18 through 20 show sections of certain portions of the diaphragm shown in FIG. 17.

FIG. 17 is a partial sectional view of a modification of the embodiment shown in FIG. 15. A modified diaphragm 55 as illustrated in FIG. 17, is constituted by two composite sheets 11 and 12 disposed in the same manner as in FIG. 15, and a plurality of ring-shaped stripe sheets 50 spaced in the radial direction of the diaphragm. The ring-shaped stripe sheets 50 act as reinforcing ribs for increasing the peripheral rigidity of the diaphragm 55, as shown in an enlarged view in FIG. 18. As shown in FIG. 18, carbon fibers F are embedded in the ring-shaped stripe sheets 50, and extend circumferentially about the central axis of the diaphragm 55.

Figure 19:
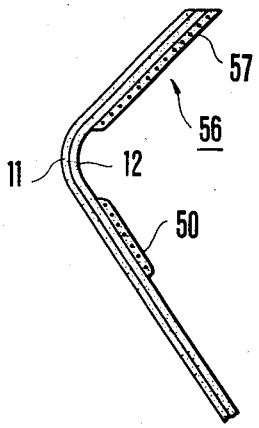

As shown in FIG. 19, a reinforcing flange 56 is formed at the outer peripheral edge of the diaphragm 55, the flange 56 being formed of bent outer peripheral portions of the composite sheets 11 and 12 and a ring-shaped sheet 57 laminated on the outer peripheral portions like the ring-shaped stripe sheet 50, so as to reinforce the outer peripheral edge of the diaphragm 55.

Figure 20:
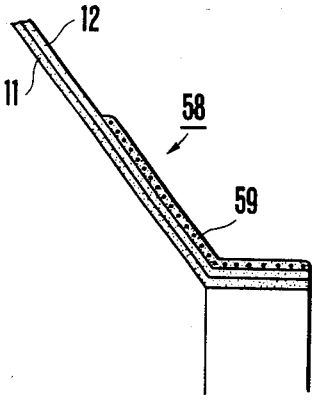

As shown in FIG. 20, a reinforcing rib 58 is formed on the inner peripheral portion of the diaphragm 55. The rib 58 is constituted by bent inner peripheral portions of the composite sheets 11 and 12 and a ring-shaped sheet 59 simultaneously laminated onto the bent portions so as to reinforce the inner peripheral edge of the diaphragm 55.

Figure 21:
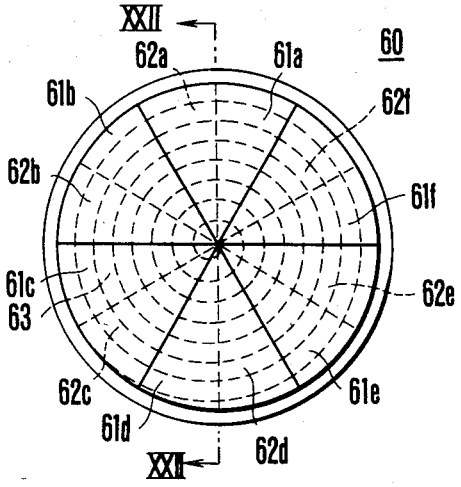
FIG. 21 is a plan view showing a modification of FIG. 9 wherein the diaphragm is changed to dome shape.
Figure 22:
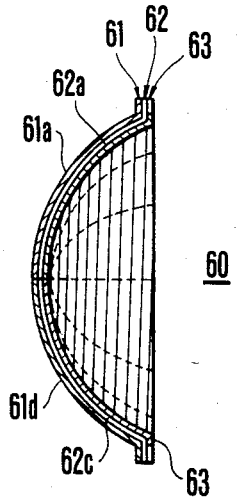
FIG. 22 is a sectional view taken along a line XXII—XXII in FIG. 21.

FIGS. 21 and 22 show a modification of the embodiment shown in FIG. 9 in which the diaphragm is shaped into a dome. The dome-shaped diaphragm shown in FIGS. 21 and 22 is constituted by a first composite sheet 61 made up of six sheet sections 61*a* to 61*f*, for example a, second composite sheet 62 made up of six sheet sections 62*a* to 62*f*, and a spirally wound stripe sheet 63 which are laminated and bonded together in the same manner as the diaphragm 40 described above, The directions of the carbon fibers of the first and second composite sheets 61 and 62 is about the radial direction of the diaphragm 60, while the direction of the carbon fibers of the spirally wound stripe sheet 63 is about the peripheral direction of the diaphragm, that is about orthogonal to the directions of the carbon fibers of the first and second composite sheets 61 and 62 respectively, also in this embodiment, the joints between the sections 61*a* to 61*f* and the sections 62*a* to 62*f*, respectively constituting the first and second composite sheets 61 and 62, are superimposed such that the joints between adjacent sections of both composite sheets do not overlap each other, that is displaced 30° in the peripheral direction.

Instead of laminating the stripe sheet 13 on the surface of the composite sheet 12, it can be interposed between the first and second composite sheets 11 and 12 or bonded to the inner surface of the first composite sheet 11. Although in the foregoing embodiments carbon fibers were used, such other fibers having a high Young's modulus to density ratio as glass fibers, graphite fibers, boron fibers, silicon carbide fibers and aromatic polyamide fibers can also be used.

The composite sheets and the stripe-shaped sheet can be made to have extremely thin thickness of about forty microns where carbon fibers having a small diameter of about ten microns are used. Since such sheets have $E/\rho$ of more than five times of light alloys, with the laminated construction described above, it is possible to obtain a diaphragm having the same or superior frequency characteristics than a diaphragm utilizing prior art materials. Moreover, the composite material utilized in this invention is cheaper than beryllium alloy and is more conducive to handling.

What is claimed is:

1. A diaphragm of an electroacoustic transducer comprising a plurality of composite sheets each including fibers having a high Young's modulus to density ratio and a matrix bonding together said fibers, said composite sheets being laminated into an integral structure, each composite sheet further comprising a plurality of adjoining sections having joints therebetween and formed by dividing the composite sheet about a central axis of said diaphragm, said composite sheets further being laminated such that the joints between the adjoining sections of one composite sheet are not disposed circumferentially at the same positions as the joints between the adjoining sections of the other composite sheet, such joints being of sufficient mechanical strength to withstand the vibrations encountered in service in a diaphragm.

2. The diaphragm of an electroacoustic transducer according to claim 1 wherein the fibers of each composite sheet extend in a substantially radial direction with respect to the direction of vibration of said diaphragm.

3. The diaphragm of an electroacoustic transducer according to claim 1 wherein said fibers are selected from the group consisting of glass fibers, carbon fibers, graphite fibers, boron fibers, silicon carbide fibers and aromatic polyamide fibers.

4. The diaphragm of an electroacoustic transducer according to claim 2 wherein circumferential side edge portions of said adjoining sections are bonded together so that they are not overlapped.

5. The diaphragm of an electroacoustic transducer according to claim 1 which further comprises a stripe-shaped composite sheet constituted by a plurality of fibers extending in the same direction and a matrix bonding together said fibers, said stripe-shaped composite sheet being laminated to a surface of one of said composite sheets with the fibers in said stripe-shaped composite sheet being substantially orthogonal to the fibers in said composite sheets.

6. The diaphragm of an electroacoustic transducer according to claim 5, said stripe-shaped composite sheet extending spirally along said surface of one of said composite sheets of said diaphragm.

7. The diaphragm of an electroacoustic transducer according to claim 1 which further comprises a plurality of ring-shaped composite sheets of different diameters which are bonded to a surface of one of said composite sheets of said diaphragm, each of said ring-shaped composite sheets comprising a plurality of fibers extending in a circumferential direction about said central axis of said diaphragm.

8. The diaphragm of an electroacoustic transducer according to claim 5 which further comprises a flange bonded to a periphery of said diaphragm.

9. The diaphragm of an electroacoustic transducer according to claim 5 which further comprises a rib bonded to a neck portion of said diaphragm.

10. A diaphragm of an electroacoustic transducer comprising a plurality of composite sheets including fibers having a high Young's modulus to density ratio and a matrix bonding together said fibers, said composite sheet being laminated into an integral structure, said composite sheet including a plurality of adjoining sections formed by dividing the composite sheet about a center axis of said diaphragm, and a stripe-shaped composite sheet constituted by a plurality of fibers extending in the same direction and a matrix bonding together said fibers, said stripe-shaped composite sheet being arranged circumferentially on a surface of one of said composite sheets of said diaphragm and being laminated to said surface with said fibers on said stripe-shaped composite sheet being substantially orthogonal to said fibers in said composite sheets.

11. The diaphragm of an electroacoustic transducer according to claim 10 wherein said stripe-shaped composite sheet is spirally wound on the surface of said one of said composite sheets of said diaphragm.

12. The diaphragm of an electroacoustic transducer according to claim 10 wherein said stripe-shaped composite sheet comprises a plurality of ring-shaped composite sheets of different diameters which are bonded to the surface of said diaphragm, each of said ring-shaped composite sheets comprising a plurality of reinforced fibers extending in a circumferential direction about said center axis of said diaphragm.

* * * * *

UNITED STATES PATENT AND TRADEMARK OFFICE

CERTIFICATE OF CORRECTION

PATENT NO. : 4,562,899

DATED : January 7, 1986

INVENTOR(S) : Akira Nakamura

Sheet 1 of 2

It is certified that error appears in the above-identified patent and that said Letters Patent is hereby corrected as shown below:

Column 1, line 29, after "occur" insert a comma ---- , ----.

Column 2, line 39, after "invention" insert a comma ---- , ----.

Column 2, line 57, after "are" insert a comma ---- , ----.

Column 3, line 3, after "cut" delete "cutting".

Column 3, line 54, delete "the", first occurrence.

Column 3, line 56, delete "the", second occurrence.

Column 3, line 57, delete "too"; same line, after "are" insert ---- also ----.

Column 5, line 14, delete "decresed" and insert ---- decreased ----.

Column 5, line 28, delete "sheet 24" and insert ---- sheet 13 ----.

Column 5, line 54, delete "Arrow" and insert ---- arrow ----.

UNITED STATES PATENT AND TRADEMARK OFFICE

CERTIFICATE OF CORRECTION

PATENT NO. : 4,562,899

DATED : January 7, 1986

INVENTOR(S) : Akira Nakamura

Sheet 2 of 2

It is certified that error appears in the above-identified patent and that said Letters Patent is hereby corrected as shown below:

Column 5, line 58, delete "frusto conical" and insert ---- frusto-conical ----.

Column 5, line 61, delete "frusto conical" and insert ---- frusto-conical ----.

Column 5, line 62, after "Then" insert ---- the ----.

Column 6, line 15, delete "cone shaped-diaphragm" and insert ---- cone-shaped diaphragm ----.

Column 7, line 3, delete "above," and insert ---- above. ----.

Column 7, line 11, delete "respectively," and insert ---- respectively. ----; same line, delete "also" and insert ---- Also ----.

Signed and Sealed this

*Fifteenth* Day of *July 1986*

[SEAL]

*Attest:*

DONALD J. QUIGG

*Attesting Officer*

*Commissioner of Patents and Trademarks*